US005243956A

United States Patent [19]

Luehring

[11] Patent Number: 5,243,956

[45] Date of Patent: Sep. 14, 1993

[54] CROSSBOW COCKING DEVICE

[75] Inventor: Elmer L. Luehring, Cleveland, Ohio

[73] Assignee: Barnett International, Inc., Odessa, Fla.

[21] Appl. No.: 860,075

[22] Filed: Mar. 30, 1992

[51] Int. Cl.[5] ..... F41B 5/12; F41B 5/18

[52] U.S. Cl. ..... 124/86; 124/25

[58] Field of Search ..... 124/17, 20.1, 20.3, 124/21, 22, 25, 25.5, 27, 28, 29, 86, 88; 410/96, 97, 100, 103; 294/132, 133, 82.1, 82.11

[56] References Cited

U.S. PATENT DOCUMENTS

| | | | |
|---|---|---|---|
| 2,523,805 | 9/1950 | Anthony | 124/29 X |
| 2,645,218 | 7/1953 | Fisher | 124/21 |
| 3,265,336 | 8/1966 | Peterson | 294/82.11 X |
| 3,520,555 | 7/1970 | Blair | 410/100 |
| 3,667,660 | 6/1972 | Lewis | 294/82.1 X |
| 4,369,009 | 1/1983 | Fulford | 410/103 X |
| 4,766,874 | 8/1988 | Nishioka | 124/25 |
| 4,911,136 | 3/1990 | Brown | 124/25 X |
| 5,115,795 | 5/1992 | Farris | 124/86 |

*Primary Examiner*—Randolph A. Reese
*Assistant Examiner*—John Ricci
*Attorney, Agent, or Firm*—Pettis & McDonald

[57] ABSTRACT

An apparatus for cocking a conventional crossbow, the crossbow having a stock with a first end and a second end. The apparatus comprises a pair of pulleys that are removably attachable to the string of the crossbow, and a cord extending through one pulley, about the second end of the crossbow stock and through the other pulley, so that by pulling the opposite ends of the string the bow may be cocked.

4 Claims, 2 Drawing Sheets

CROSSBOW COCKING DEVICE

BACKGROUND OF THE INVENTION

1. Field of the Invention

The present invention relates to a crossbow cocking device whereby one person may easily and safely draw back the string of a crossbow to engage the trigger mechanism.

2. Description of the Prior Art

It is certainly well known that crossbows are difficult to cock due to the powerful prods that are used by this equipment. Over the years various apparatus has been developed to provide an easier method for drawing a bow string for engagement with a trigger mechanism. Such devices have included levers, windlasses, and built-in pulley systems that are attached to the stock of the bow. One such device is disclosed by U.S. Pat. No. 4,662,345 which was issued to Stephens. The crossbow of this invention is cocked by holding the grip of the device in one hand and pulling a cocking handle with the other hand. Pulling the cocking handle moves a pulley carriage to which the bow string is engaged, toward the trigger mechanism, which captures the bow string. The pulley carriage is automatically returned to its original position by the use of springs or elastic bands. It remains clear that a simple, light, portable device for cocking a crossbow is needed.

SUMMARY OF THE INVENTION

The present invention relates to a crossbow cocking device that is used in combination with a conventional crossbow. Such a conventional crossbow has a stock with a first end and a second end, a first side and a second side, a prod attached proximal to the first end of the stock, a string attached to the prod and a trigger mechanism located intermediate the first end and the second end of the stock. The cocking device is comprised of a pair of guide means each of which have an attaching means attached thereto for removable attachment to the bow string. Both guide means engage a cord that has a first and a second end. One guide means is attached by its attaching means to the bow string at a point adjacent to the first side of the stock. The cord is then passed around the second end of the stock and the other guide means is attached by its attaching means to the bow string at a point adjacent to the second side of the crossbow. By generally simultaneously pulling on the first and second ends of the cord, the bow string is moved toward the second end of the stock until it is captured by the trigger mechanism.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
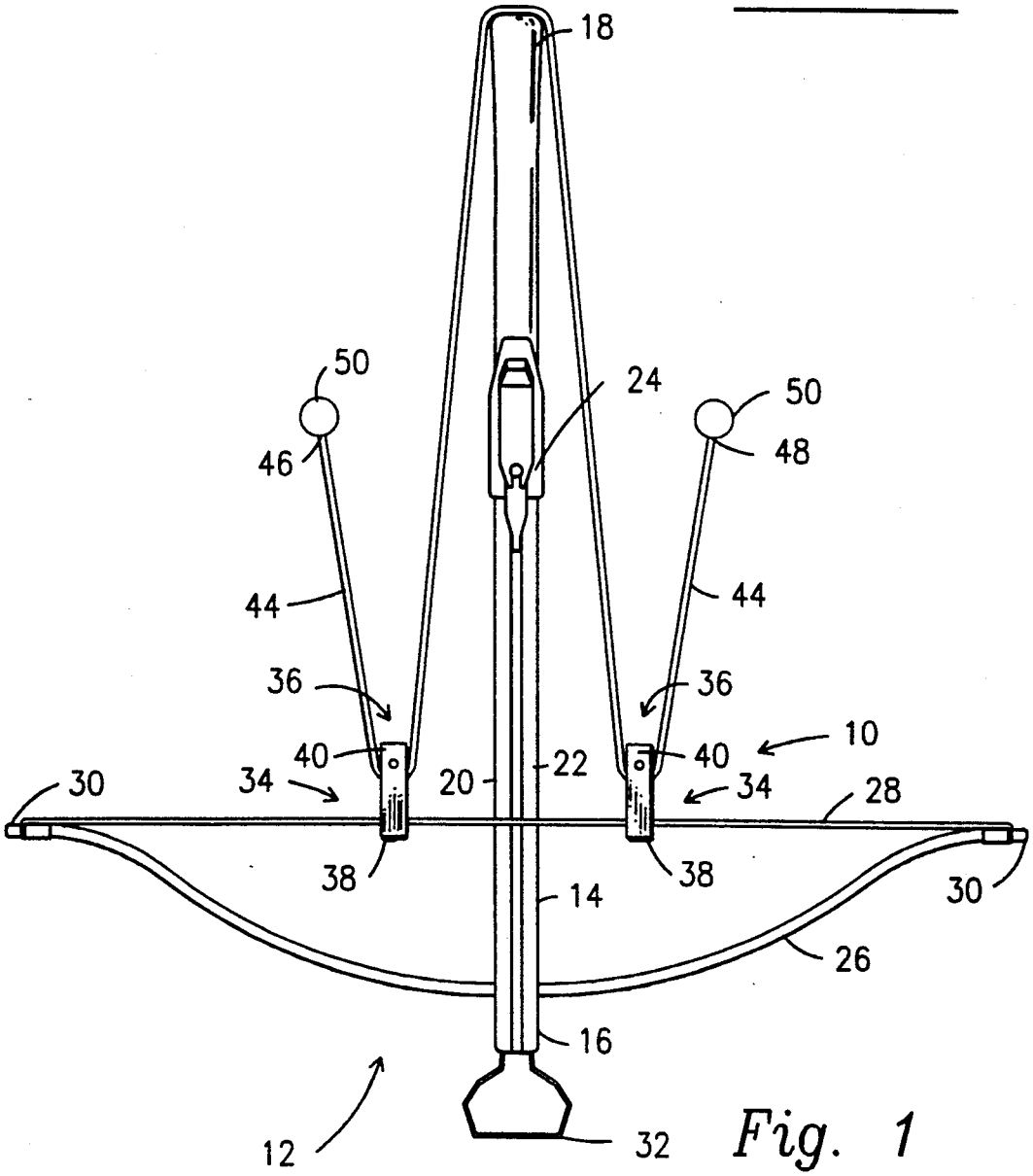
FIG. 1 is a plan view of the preferred embodiment of the crossbow cocking device, illustrating that device attached to a conventional crossbow.
Figure 3:
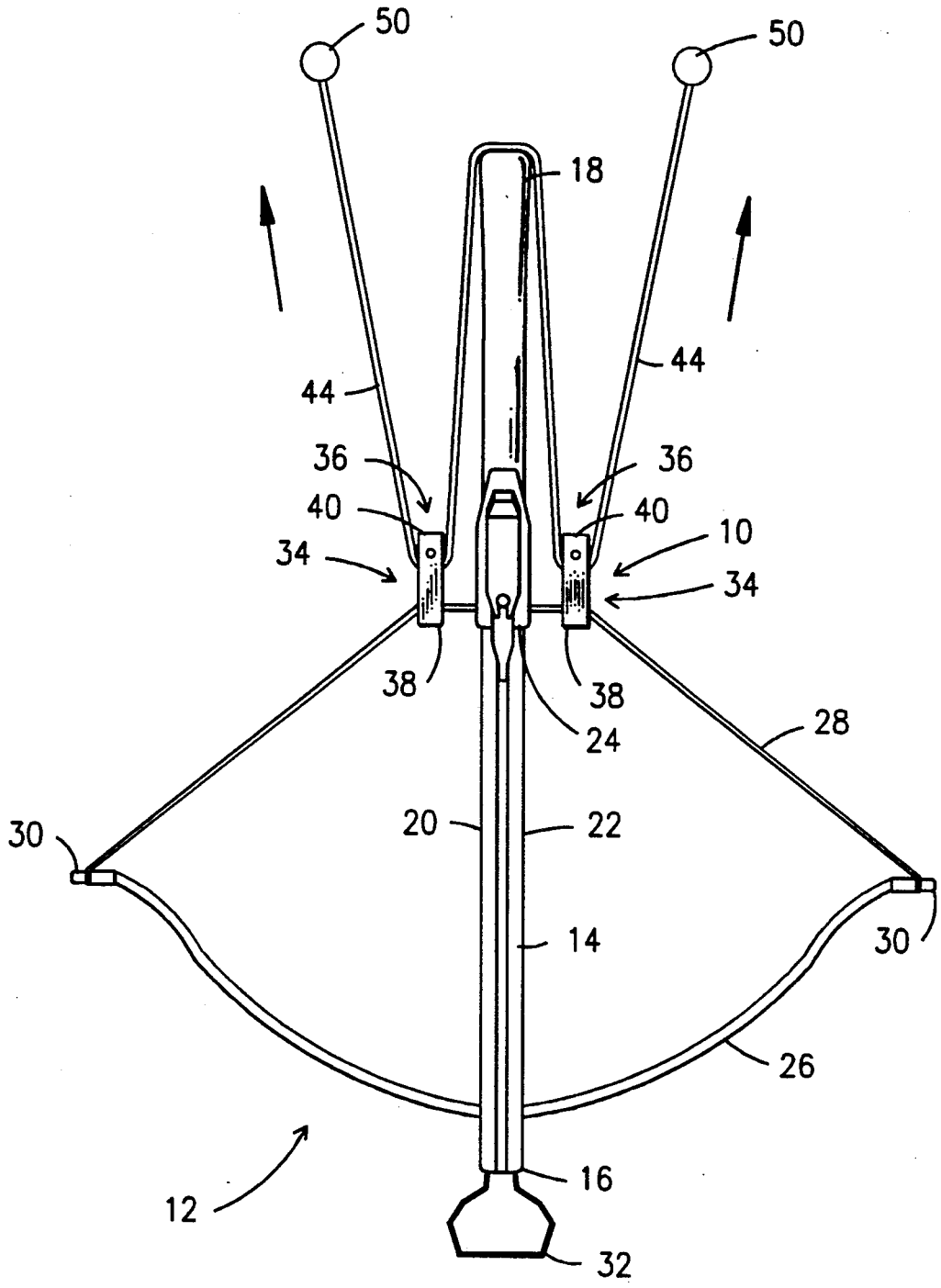
FIG. 3 is a plan view of the device shown in FIG. 1, illustrating movement of the bow string to the cocked position.

A preferred embodiment of the crossbow cocking device is illustrated in the drawing figures and is generally indicated as 10 in the views of FIGS. 1 and 3. The conventional crossbow is generally indicated as 12 in FIGS. 1 and 3.

The crossbow 12 is comprised of a stock 14 that has a first end 16 and a second end 18, a first side 20 and a second side 22. A trigger mechanism 24 is mounted to the stock 14 intermediate the first end 16 and the second end 18 of the stock 14. A prod 26 is attached to the stock 14 proximal to the first end 16 of the stock 14. A string 28 is attached to each end 30 of the prod 26. Attached proximal to the first end 16 of the stock 14 is a stirrup 32. The stirrup 32 is not a part of a conventional crossbow, but provides additional support to the crossbow during the cocking operation.

Figure 2:
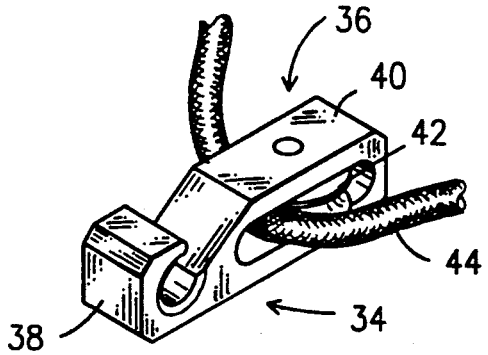
FIG. 2 is a perspective view of a portion of the device of FIG. 1.

The cocking device 10 is comprised of a pair of guide means shown generally as 34, which are each comprised of a pulley shown generally as 36 and an attaching means, conveniently hook 38. As can be seen more clearly in FIG. 2 the pulley 36 is comprised of a block 40 and a sheave 42. In the preferred embodiment the guide means 34 is formed from aluminum but may be made from any suitable material including, but not limited, to steel, brass, other metal or a generally rigid synthetic resin. A cord 44 having a first end 46 and a second end 48, as illustrated in FIG. 1, engages each guide means 34 by passing through the block 40 of the guide means 34 so that the cord 44 passes between the sheave 42 and a portion of the block 40, generally referred to as the swallow. In the operating position, as seen in FIGS. 1 and 3, each guide means 34 is attached by its hook 38 to the bow string 28, each at a point adjacent to opposing sides 20 and 22 of the stock 14. The portion of the cord 44 between the pair of guide means 34 is then looped firmly about the second end 18 of the stock 14. In the preferred embodiment the cord 44 is made from woven nylon fibers; however, the cord 44 may be constructed of any suitable material including, but not limited to wire, woven wire, or cords made of any suitable fibers.

Having thus set forth a preferred construction for the crossbow cocking device 10 of this invention, it is to be remembered that this is but a preferred embodiment. Attention is now invited to a description of the use of the cocking device 10. In order to cock a conventional crossbow illustrated as 12, the cocking device is removably attached to the crossbow 12 as illustrated in FIG. 1. That is, the pair of the guide means 34 are attached to the crossbow 12 so that one guide means 34 is located adjacent to the first side 20 of the stock 14 and the second guide means 34 is located adjacent the second side 22 of the stock 14. Each guide means 34 is attached to the string 28 by capturing the string 28 within the hook 38 of the guide means 34. A loop of cord 44 is permitted to extend between the guide means 34 so that the cord 44 engages the second end 18 of the stock 14. By pulling generally simultaneously on the handles 50, and thus the cord 44, the cocking device 10 is held in position in relation to the string 28 and the second end 18 of the stock 14. For increased stability a person's foot may be placed within stirrup 32, if a stirrup is provided. As illustrated in FIG. 3 by pulling generally simultaneously on the handles 50, the string 28 is moved toward the second end 18 of the stock 14 until the string 28 is captured by the trigger mechanism 24. The cocking device 10 reduces the pulling force needed to cock a crossbow to about half the usual pull. The cocking device 10 may now be removed and the crossbow is now cocked and ready for firing.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has ben described, what is claimed is:

1. A crossbow cocking device used in combination with a crossbow having a stock, the stock having a first end and a second end, a first side and a second side, a prod attached to the stock proximal the first end thereof, a bow string operatively attached to the prod, and a trigger mechanism operatively mounted on the stock intermediate the first and second ends thereof, said cocking device comprising:

a pair of guide means each comprising attaching means, so that one said guide means may be removably attached to a portion of the string proximal to the first side of the stock and the other said guide means may be removably attached to a portion of the string proximal to the second side of the stock; and a cord having a first and a second end, said pair of guide means being movably mounted on said cord such that a cord segment between said pair of guide means may engage the second end of the stock when said attaching means are attached to the string, so that pulling on said first and second ends of said cord will move the string toward the second end of the stock until the string is captured by the trigger mechanism.

2. A device as in claim 1 wherein each of said guide means comprises a pulley, each pulley comprising a block having a sheave mounted therein, said cord passing through said block between a portion of said block and said sheave and said attaching means being attached to said block.

3. A device as in claim 1 wherein said attaching means comprises a hook sized and configured to receive the string, said hook being attached to said block.

4. A device as in claim 1 further comprising a gripping means attached to said first end and said second end of said cord.

* * * * *